US011441296B2

(12) United States Patent
Bingham et al.

(10) Patent No.: US 11,441,296 B2
(45) Date of Patent: Sep. 13, 2022

(54) LOCK FOR SECURING A WEAR MEMBER

(71) Applicant: ESCO GROUP LLC, Portland, OR (US)

(72) Inventors: Bruce C. Bingham, West Linn, OR (US); Michael B. Roska, Portland, OR (US); Darrin Harding, Newberg, OR (US); Mark T. Beatley, Saint Helens, OR (US); Cornelius J. Brockman, Swakopmund (NA)

(73) Assignee: ESCO GROUP LLC, Portland, OR (US)

( * ) Notice: Subject to any disclaimer, the term of this patent is extended or adjusted under 35 U.S.C. 154(b) by 189 days.

(21) Appl. No.: 16/671,096

(22) Filed: Oct. 31, 2019

(65) Prior Publication Data

US 2020/0131743 A1 Apr. 30, 2020

Related U.S. Application Data

(60) Provisional application No. 62/753,675, filed on Oct. 31, 2018.

(51) Int. Cl.
*E02F 9/28* (2006.01)

(52) U.S. Cl.
CPC ..... *E02F 9/2883* (2013.01); *E02F 9/2833* (2013.01)

(58) Field of Classification Search
CPC ..... E02F 9/2833; E02F 9/2841
See application file for complete search history.

(56) References Cited

U.S. PATENT DOCUMENTS 951,437 A * 3/1910 Gehrke ..... B65D 39/084 411/386
2,053,918 A * 9/1936 Peretsman ..... F28F 11/04 411/386
2,666,354 A * 1/1954 Dim ..... F16B 43/001 206/568
4,027,408 A 6/1977 Ramella et al.
4,096,653 A * 6/1978 Kaarlela ..... E02F 9/2841 37/457
4,918,843 A * 4/1990 Kiesewetter ..... E02F 9/2841 267/141
6,052,927 A 4/2000 Pippins
6,108,950 A 8/2000 Ruvang et al.
6,231,286 B1 * 5/2001 Bogatz ..... F16B 33/004 411/533
6,283,691 B1 * 9/2001 Bogatz ..... F16B 33/004 411/371.1

(Continued)

*Primary Examiner* — Gary S Hartmann
(74) *Attorney, Agent, or Firm* — Steven Schad; Palmer Dzurella

(57) ABSTRACT

A lock that includes a pin and a collar. At least one of the pin and collar include a circular seal and a recess to store the seal. When the pin and collar are engaged in a locking manner, the surfaces of the pin and collar compress the seal such that a barrier is formed to limit ingress of fine earthen material. The lock assembly may be a component of a wear assembly. The lock assembly may be positioned into aligned holes to capture components of the wear assembly together, e.g. a point to an adapter or an adapter to a base. The recess of the pin may be located adjacent the head of the pin. The recess of collar may be located near the bottom of the collar. The application of both an upper and lower seal can further limit the ingress of fine earthen material.

11 Claims, 7 Drawing Sheets

(56) References Cited

U.S. PATENT DOCUMENTS

| | | | | |
|---|---|---|---|---|
| 6,347,708 | B1 * | 2/2002 | Ostergaard | F16B 43/001 209/326 |
| 6,757,995 | B2 | 7/2004 | Pippins | |
| 6,764,262 | B1 * | 7/2004 | Hargis | F16B 43/001 411/371.1 |
| 6,848,203 | B2 | 2/2005 | Hohmann et al. | |
| 6,976,325 | B2 | 12/2005 | Robinson et al. | |
| 7,645,105 | B2 * | 1/2010 | Hengel | B23K 11/0053 24/270 |
| 7,740,433 | B2 * | 6/2010 | Miyoshi | F16B 43/001 411/371.1 |
| 7,832,129 | B2 * | 11/2010 | Briscoe | E02F 9/2883 37/456 |
| 8,104,200 | B2 * | 1/2012 | Briscoe | E02F 9/2841 37/456 |
| 8,127,476 | B2 * | 3/2012 | Bierwith | E02F 9/2833 172/772 |
| 8,186,921 | B2 * | 5/2012 | Lowman | F01M 11/0408 411/383 |
| 9,222,243 | B2 | 12/2015 | Cheyne et al. | |
| 10,563,381 | B2 * | 2/2020 | Voelz | E02F 9/2841 |
| 10,589,278 | B2 * | 3/2020 | Johnson | B02C 4/305 |
| 11,174,890 | B1 * | 11/2021 | Bjerke | E02F 9/2833 |
| 2004/0098886 | A1 * | 5/2004 | Hohmann | E02F 9/2825 37/451 |
| 2014/0245645 | A1 * | 9/2014 | Marchand | E02F 9/2825 37/444 |
| 2014/0271033 | A1 * | 9/2014 | Johnson | F28F 9/10 411/371.1 |
| 2019/0145455 | A1 * | 5/2019 | Curhan | B25J 9/142 411/371.1 |

* cited by examiner

LOCK FOR SECURING A WEAR MEMBER

RELATED APPLICATIONS

This application claims priority to U.S. Provisional Patent Application No. 62/753,675, filed Oct. 31, 2018, entitled "Wear Assembly," which is incorporated by reference in its entirety herein and made a part hereof.

FIELD OF THE INVENTION

The present disclosure pertains to a wear assembly for use on various kinds of equipment used in abrasive environments.

BACKGROUND

In mining and construction, wear parts are commonly provided along a digging edge of an excavating bucket. The wear parts protect the underlying equipment from undue wear and, in some cases, also perform other functions such as breaking up the ground ahead of the digging edge. During use, the wear parts typically encounter heavy loading and highly abrasive conditions. As a result, they must be periodically replaced. Speed and ease for such replacement are desired.

These wear parts usually comprise two or more components such as a base that is secured to the digging edge, and a wear member that mounts on the base to engage the ground. The wear member tends to wear out more quickly and is typically replaced a number of times before the base must also be replaced. One example of such a wear part is an excavating tooth that is attached to the lip of a bucket for an excavating machine. A tooth can include an adapter secured to the lip of a bucket and a point attached to the adapter to initiate contact with the ground. A lock is received in aligned openings of the point and adapter to hold the components together.

SUMMARY OF THE INVENTION

The present disclosure pertains to a wear assembly for use on various kinds of equipment including, for example, excavating machines, conveying means, comminution, etc.

In one embodiment, a lock for securing a wear member to a base includes a threaded pin received in an opening in the wear member having threads. The lock includes at least one seal between the pin and the wall of the opening to inhibit the ingress of fines and thereby mitigate the risk of fines binding the pin and impeding its rotation in the opening.

In another embodiment, the lock includes a threaded collar secured in an opening in the wear member and a threaded pin movable in the collar for securing the wear member to a base. One or more seals are located between the pin and the collar to hinder the ingress of fines into the threads.

In another embodiment, a lock includes a threaded, tapered pin received into a threaded opening in a wear member. The threads could optionally be provided by a collar secured in the opening. At least one seal is provided in the collar so as to be compressed as the widening pin is driven farther into the collar to form a barrier against the ingress of fines.

In another embodiment, a lock includes a threaded pin received into a threaded collar. The pin includes a widened head on the trailing end. A seal is compressed between the head and an outer surface of the collar to form a barrier against the ingress of fines.

In another embodiment, a lock includes a threaded collar and a threaded tapered pin received into the collar, where the collar and the pin each include a seal. Advancing the pin in the collar causes the pin to contact and compress the seal on the collar, and for the collar to contact and compress the seal on the pin to inhibit the ingress of fines into the threads.

In another embodiment, a lock includes threaded pin movable inward to secure a wear member to a base, which includes a thread space sealed from outside contaminants. In one example, the lock includes a threaded pin and threaded collar that engage each other—each with a seal that is compressed by the other of the pin and collar.

In another embodiment, a lock includes a tapered and threaded pin that is engaged in a threaded lock opening in a wear member. The pin has a leading end that engages the base to hold the wear member to the base, and a trailing end that is engageable by a tool. The pin widens at least partially along its length from the leading end toward the trailing end. The widening of the pin causes seals in the lock to compress between the pin and the opening wall to inhibit the ingress of fines into the engaged threads.

In another embodiment, a lock includes a tapered and threaded pin that is engaged in a threaded collar secured in a lock opening in a wear member. The pin has a leading end that engages the base to hold the wear member to the base, and a trailing end that is engageable by a tool. The pin widens at least partially along its length from the leading end toward the trailing end. The widening of the pin causes seals in the lock to compress between the pin and collar to inhibit the ingress of fines into the engaged threads.

In another embodiment, a method of protecting a lock from contaminants includes positioning a ring seal in a recess in a threaded pin and positioning a ring seal in a recess of a threaded collar. Then engaging the threads of the pin with the threads of the collar to advance the pin in the collar and compressing each seal between the collar and the pin as the pin advances.

In another embodiment, a tapered pin of a lock to secure a wear member to a base advances into a ring seal held in a recess of a collar so the increasing diameter of the pin compresses the ring seal in the recess to create a barrier to inhibit the ingress of fines.

In another embodiment, a tapered pin for securing a wear member to a base includes a ring seal in a recess under a head of the pin and the pin seal is compressed in the recess as the head of the pin meets a top surface of a collar secured in the lock opening of a wear member.

In another embodiment, a tapered pin for securing a wear member to a base includes threads and an O-ring. The O-ring is optionally in a recess of the pin adjacent a head of the tapered pin.

DETAILED DESCRIPTION OF THE PREFERRED EMBODIMENTS

The present disclosure pertains to a wear assembly for various kinds of earth working equipment including, for example, excavating equipment, comminution, conveying equipment, etc. Earth working equipment is intended as a general term to refer to any of a variety of machines used in mining, construction, mineral processing, and other activities. Examples include dragline machines, cable shovels, face shovels, hydraulic excavators, dredge cutters, crushing equipment, shear mining machines, continuous miners, etc. Earth working equipment also refers to the earth-engaging components of these machines that are working the earthen material such as the bucket, drum, etc.

Relative terms such as front, rear, top, bottom and the like are used for convenience of discussion. The terms front or forward are generally used to indicate the normal direction of travel during use (e.g., while digging), and upper or top are generally used as a reference to the surface over which the material passes when, for example, it is gathered into a bucket. Nevertheless, it is recognized that in the operation of various earth working equipment the wear assemblies may be oriented in various ways and move in all kinds of directions during use.

Figure 1:
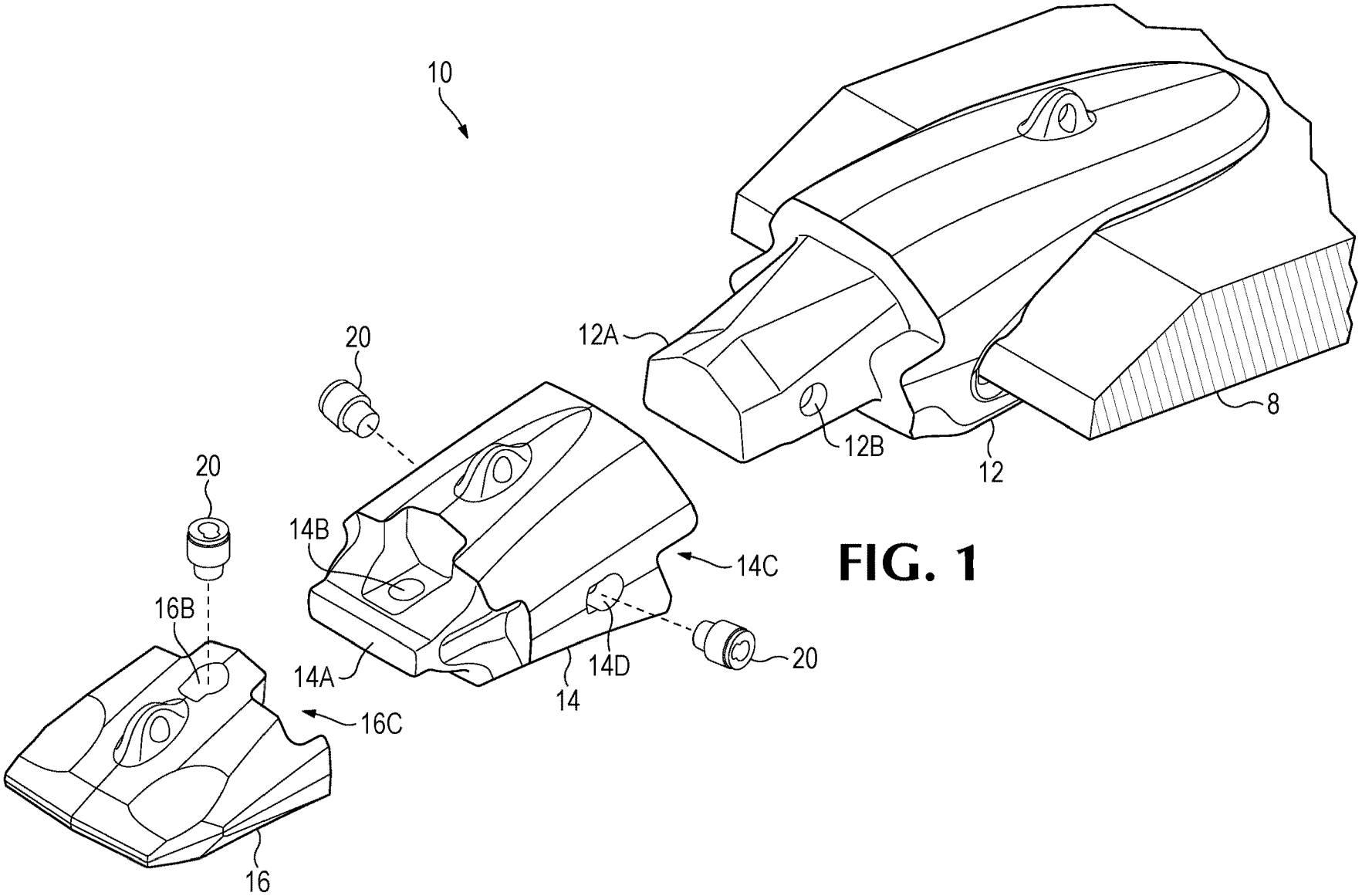
FIG. 1 is a perspective view of a wear assembly in accordance with the present disclosure.
Figure 2:
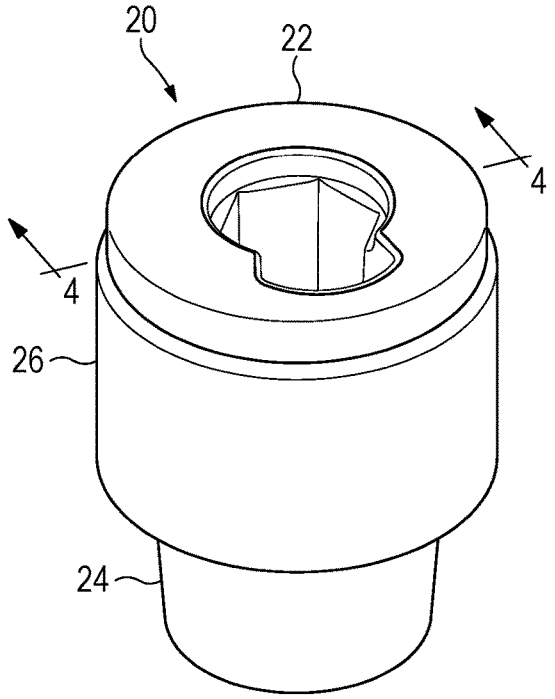
FIG. 2 is a perspective view of a lock.
Figure 3:
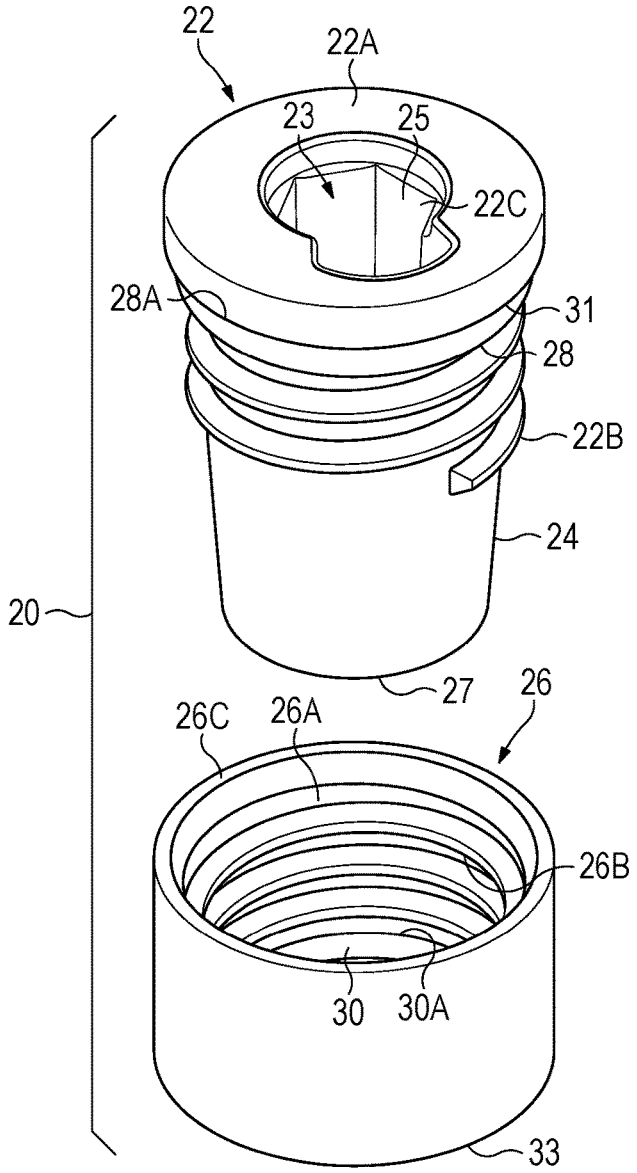
FIG. 3 is an exploded perspective view of the lock.

Referring to FIG. 1, in the illustrated example, a wear assembly 10 in accordance with the present disclosure is an excavating tooth 10 that attaches to a lip 8 of a bucket. Aside from the differences disclosed herein, the illustrated tooth 10 has the same general construction as disclosed in U.S. Pat. No. 9,222,243, which is incorporated by reference herein in its entirety. Briefly, tooth 10 includes an adapter 12 welded to lip 8, an intermediate adapter 14 mounted on the adapter 12, and a point (also called a tip or wear member) 16 mounted on adapter 14. While one tooth construction is shown, other tooth arrangements are possible. As examples only, the wear assembly may have a nose projecting from the lip instead of adapter 12, adapter 12 may be secured by a locking assembly, a point may fit directly on the nose or adapter without an intermediate adapter, the components may have different constructions, etc.

The intermediate adapter 14 includes a rearwardly-opening cavity 14C to receive nose 12A at the front end of adapter 12. Adapter 14 includes a forwardly-projecting nose 14A to mount point 16. Point 16 includes a rearwardly-opening cavity 16C to receive nose 14A, and a front end to penetrate the ground. Locks 20 are used to secure wear member or point 16 to adapter 14, and adapter 14 to base 12.

A central hole 16B is formed in wear member 16 that opens to the cavity 16C. Nose 14A of adapter 14 includes a hole 14B that aligns with hole 16B when wear member 16 is mounted on nose 14A. Lock 20 is received into the holes 16B and 14B to hold wear member 16 to adapter 14.

A hole 14D is provided on each side of adapter 14 for receiving the respective lock 20. Further, a hole 12B, like hole 14B, is provided in the opposite sides of nose 12A. Holes 12B are preferably closed but could be interconnected through nose 12A. Holes 12B, 14D align when the adapter 14 is mounted to nose 12A of the base 14. Locks 20 are received into the aligned holes 12B, 14D on each side to secure the adapter 14 to the base 12.

In this embodiment, all the locks 20 are the same, but they could have a different construction. For example, the locks securing the adapter to the base could be different in size and/or construction than the lock securing the point to the adapter. The locks are used to secure a wear member to a base. In regard to tooth 10, point 16 may be considered a wear member that is secured to a base in the form of an intermediate adapter 14. Similarly, intermediate adapter 14 may be considered a wear member that is secured to a base in the form of adapter 12.

Referring to FIGS. 2-7B, in the illustrated example, a lock 20 can include a pin 22 and a collar 26. Collar 26 includes an opening 26A for receiving pin 22. The opening 26A includes threads 26B to engage matching threads 22B on the pin 22. Collar 26 is preferably a single unit (one piece or assembled as a unit), and preferably a one-piece construction for strength and simplicity. In this example, an inner seal 30 is retained in a recess 30A in the wall forming opening 26A in the collar (FIG. 4B). Seal 30 may be an elastic O-ring, though other kinds of seals could be used. Alternatively, the threads 26B could be formed in the walls of the lock openings 14D, 16B without a separate collar member. In such a case, recess 30A would receive inner seal 30 (see FIG. 7B).

Figure 4:
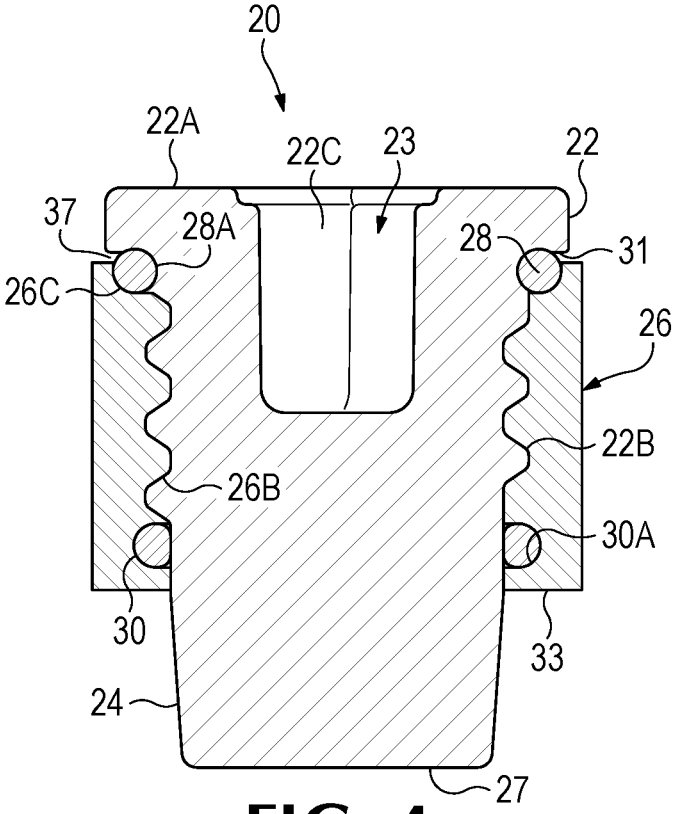
FIG. 4 is a cross section of the lock taken along line 4-4 in FIG. 2.

Pin 22 includes a tool-receiving formation 22C for turning the pin 22. In the illustrated example, the formation 22C includes a hole 23 with facets 25 in head 22A for receiving, e.g., a hex wrench. The pin 22 can include a distal tapering shank 24 extending away from the head with threads 22B. In this example, an outer seal 28 is retained in a recess 28A inward of the head 22A on pin 22 (FIG. 4). The outer and inner seal 28, 30 provide a closed thread space for the assembled lock. The seals could be reversed so that the inner seal is on the pin and the outer seal on the collar. Either seal 28, 30 could be positioned on the collar or the pin in alternative embodiments. As an example only, the seals can be positioned between 0 cm to 5 cm from top and bottom surfaces 31, 33, respectively (this is not intended to be limiting).

As pin 22 is received into collar 26, threads 22B engage threads 26B; the pin 22 rotates to advance into opening 26A of the collar. Tapered shank 24 advances into seal 30 such that the increasing diameter of the shank 24 engages the seal 30 to compress the seal 30 between the recess 30A and the shank 24. As the pin 22 advances further, an outer seal 28 contacts the collar outer surface 26C and is compressed between the shelf surface 31 and the outer surface 26C, such that a gap 37 is created (e.g. as a non-limiting example, between 0.01 cm to 5 cm, preferably between 0.01 cm to 1 cm). Alternatively, outer surface 26C can be formed with a recess that receives outer seal 28 and provides increased surface area to fully engage the seal 28 without a gap. While it is preferred to compress the outer seal between the head and the collar, the head could be omitted, or the outer seal spaced from the head, so the seal is compressed between the pin and the collar. In another example, either inner or outer seal 28, 30 could be a sole seal to limit intrusion of fines. With the pin 22 fully inserted in the collar 26, the outer and inner seals 28 and 30 seal the engaged threads from the top and bottom of the lock assembly 20. This seal arrangement limits intrusion of fines into the threads and limits binding of the threads. The seals 28, 30 are compressed upon assembly of the lock 20.

The seals 28, 30 can have different arrangements. For example, the inner and outer seals 28, 30 could both be secured to the collar 26 or both secured to the pin 22 prior to assembly. The outer pin 28 could be secured to the collar and the inner seal 30 secured to the pin. In one example, the pin 22 could be tapered to compress both an inner and outer seal 28, 30 secured in the collar. While two seals 28, 30 are shown in the drawings, additional seals could be optionally provided.

In another alternative, the pin shank 24 could have a cylindrical configuration. Seals 28, 30 could be provided on both sides of the threads 22B to limit the ingress of fines. A tapered shank 24, however, is preferred because the use of a cylindrical body that slides into a cylindrical opening with O-ring seals that are compressed by an interference fit may only provide limited compression of the O-rings and therefore may not provide as complete a seal as can be obtained by advancing a tapered shank 24 through the inner seal 30. Sealing is also improved by using a lid-type seal on the outer seal 28 (i.e., between the head and the collar). In the illustrated embodiment, the combined use of a tapered shank compressing inner seal 30 and a head compressing the outer seal against the collar provides a good seal such that limited fines will invade the thread space during operations. Other arrangements are possible.

Pin shank 24 is preferably unthreaded on its leading end 27 for receipt into hole 14B in nose 14A (or hole 12B). Pin 22 is installed into collar 26 from outside the wear member so that pin end 27 is the leading end and pin threads 22B engage collar threads 26B. A hex socket 23 (or other tool-engaging formation) is formed in head 22A, at the proximal end, for receipt of a tool to turn pin 22 in collar 26. The leading end 27 when fully inserted will engage in hole 12B or 14B to secure the wear member to the base. The trailing end could be formed without a head, in which case the outer seal (if provided) would compress between the pin shank and the wall of the lock opening.

Figure 5A:
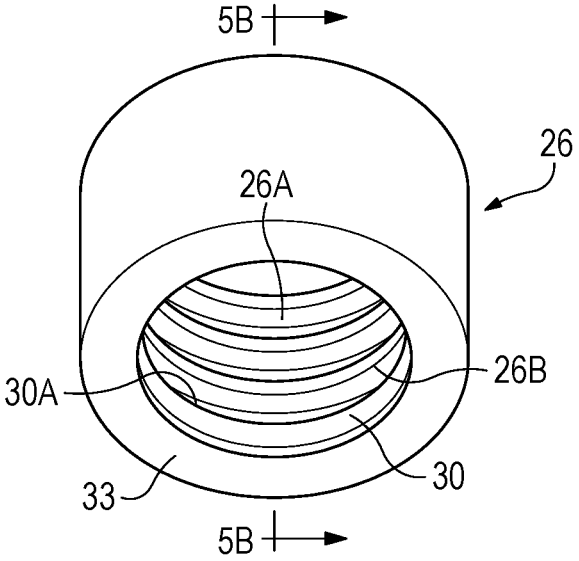
FIG. 5A is a bottom perspective view of the lock collar.
Figure 5B:
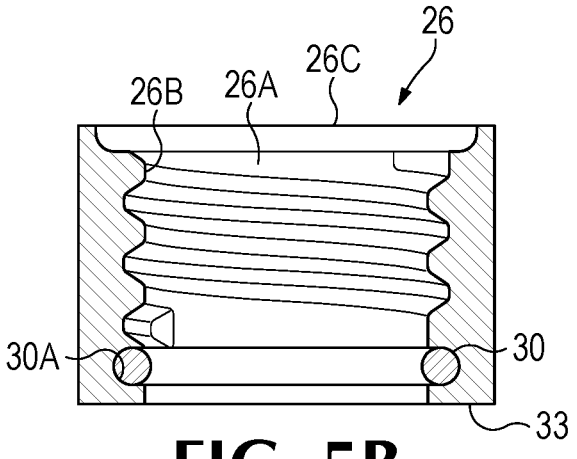
FIG. 5B is a cross section view of the lock collar taken along line 5B-5B in FIG. 5A.
Figure 6A:
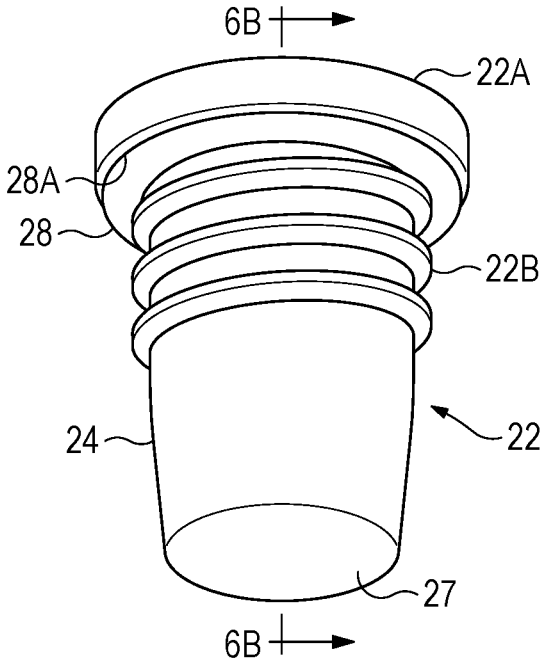
FIG. 6A is a perspective view of the lock pin.
Figure 6B:
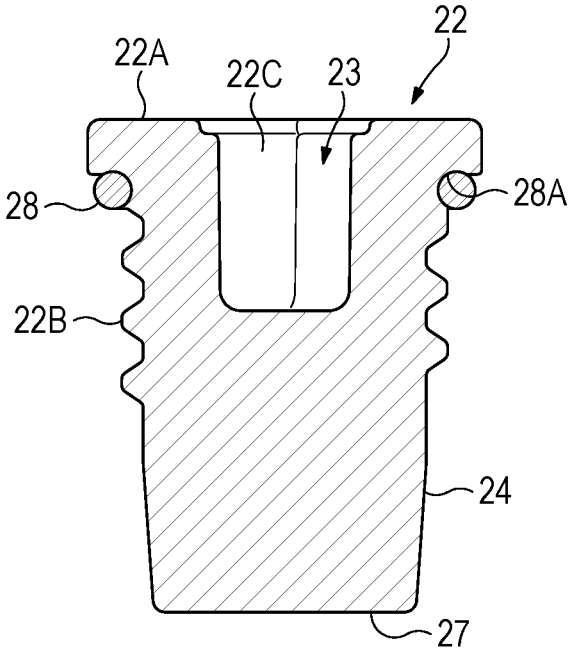
FIG. 6B is a cross section view of the lock pin taken along line 6B-6B in FIG. 6A.
Figure 7A:
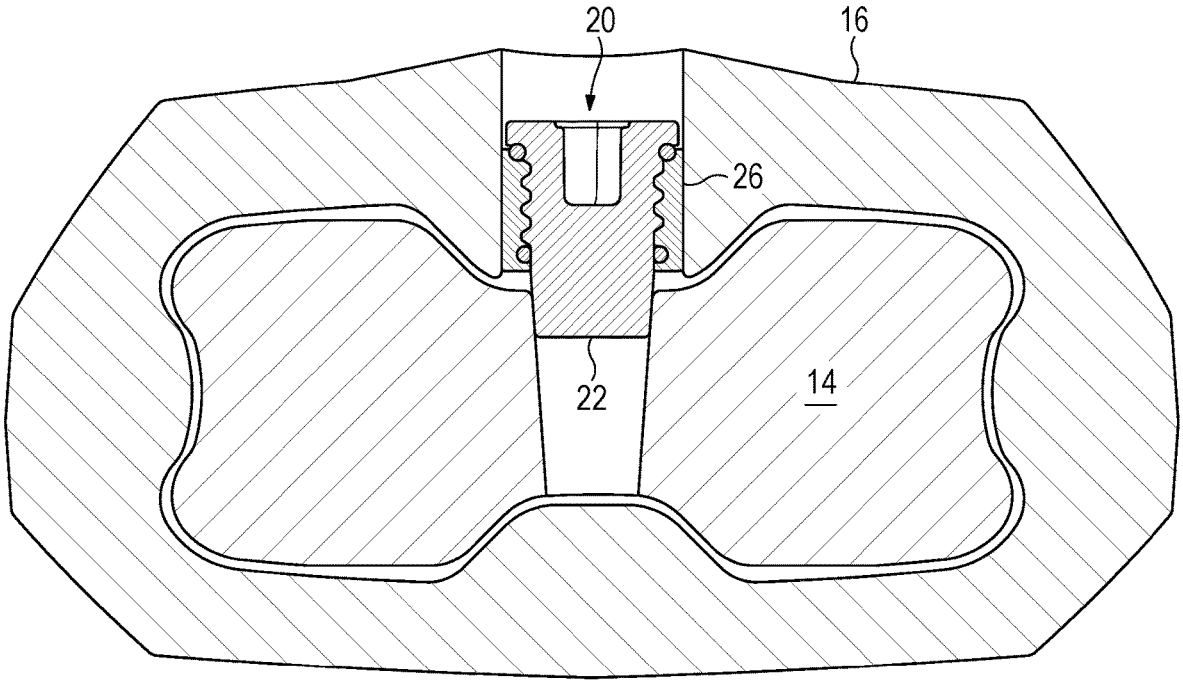
FIG. 7A is a cross section view of a point and an adapter of the wear assembly of FIG. 1 secured together taken along a transverse plane through the lock opening in the point.
Figure 7B:
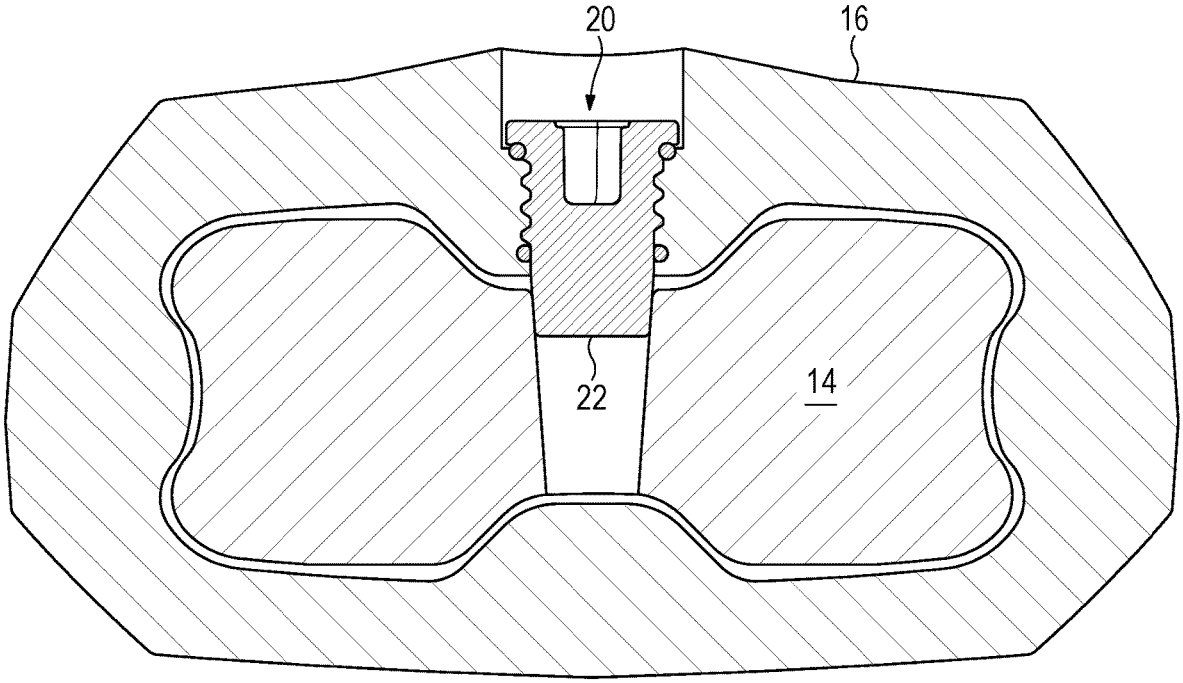
FIG. 7B is a cross section view of a point and an adapter of the wear assembly in a second configuration.

Referring to FIG. 5, the illustrated collar 26 can be installed in the holes 14D, 16B of the adapter 14 and the point 16, respectively, in various ways including welding, a threaded collar and hole, an interference fit, tapered holes receiving a corresponding tapered collar 26 and other methods. The collar 26 can be secured in the lock opening 14B, 16B by lugs and a clip as disclosed in U.S. Pat. No. 9,222,243.

Figure 8:
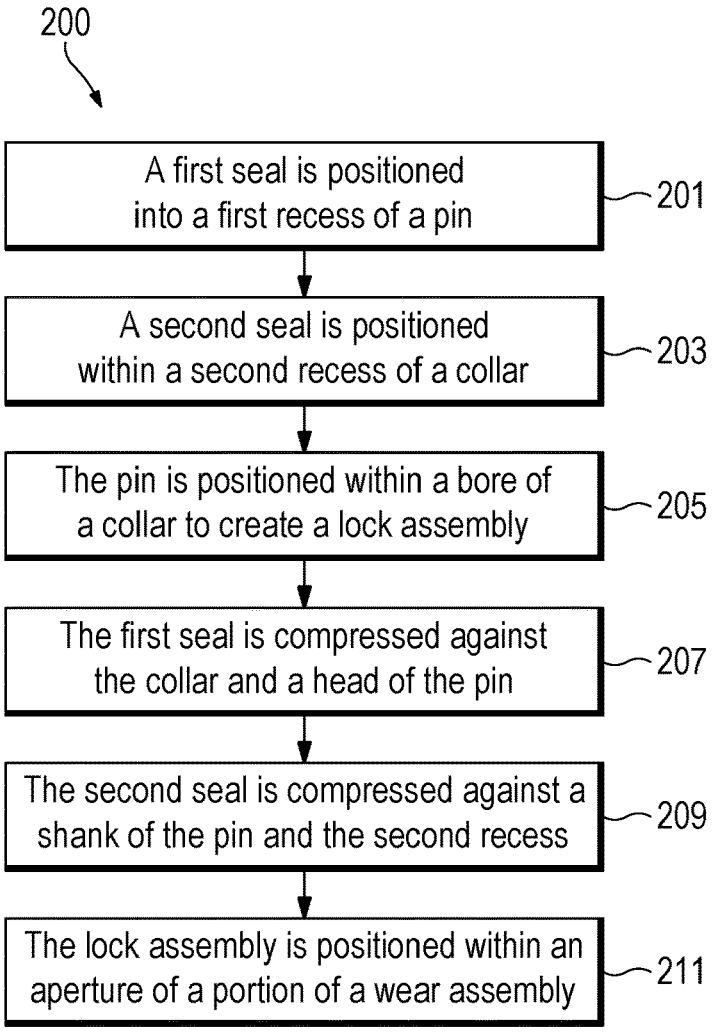
FIG. 8 is a process for inserting a pin into a collar to form a lock assembly according to one example of the disclosure.

With reference to FIG. 8, a process 200 for assembling a lock assemble 20 that protects the lock assembly from contaminants is disclosed. In step 201, a first seal is positioned into a first recess 28A of a pin. The first seal may be ring shaped or an elastic O-ring. The first recess 28A may be located adjacent the head 22A of the pin or may be located lower. In step 203, a second seal 30 is positioned within a second recess 30A of a collar 26. In step 205, the pin 22 and first seal 28 are positioned within a bore 23 of a collar 26. The lock assembly 20 is formed with the engagement of the pin 22 and collar 26. In step 207, the first seal 28A is compressed against the collar 26 and a head 27 of the pin 22 (or between the pin and the collar if the seal is spaced from the head). In one example, the engagement between the collar 26 and the pin 22 may leave a gap 37 between the head 22A and a top surface 26C of the collar 26. Alternatively, the engagement between the collar 26 and the pin 22 may fully engage between the head 22A and a top surface 26C of the collar 26. In step 209, the second seal 30 is compressed against a shank 25 of the pin 22 and the second recess 30A. In some examples, the shank 25 may be tapered, such that as a wider portion of the shank 25 is descended further into the bore 23 of the collar 26, the second seal 30 is further compressed. The seals 28, 30 further limit fine earthen material from entering and jamming the lock assembly 20. In step 211, the lock assembly 20 is positioned within an aperture of a wear assembly 10. Although steps 207, 209 and 211 are discussed in terms of separate steps for ease of discussion, they preferably all occur at the same time; i.e., when leading end 27 is received into hole 12B, 14B the inner and outer seals are both simultaneously compressed. Nevertheless, the compression of a seal between the pin shank and the wall of the opening could occur before the leading end is fully seated in hole 12B, 14B.

Figure 9:
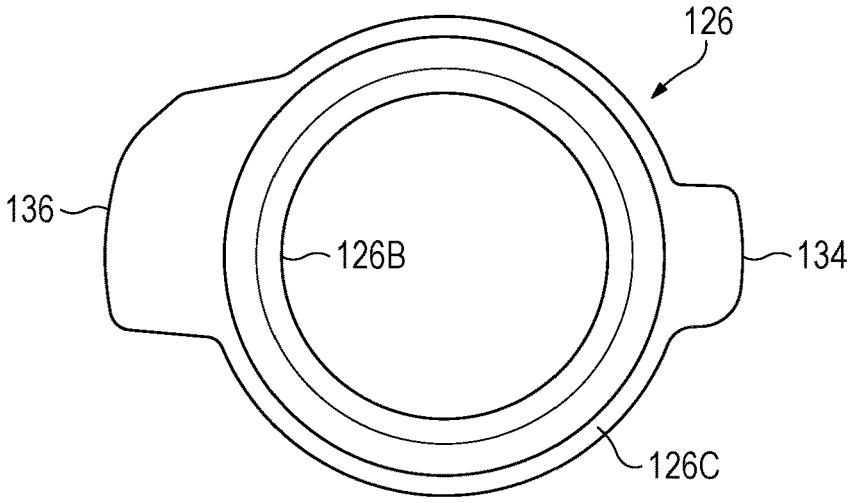
FIG. 9 is a top view of the lock collar according to a second implementation.
Figure 10:
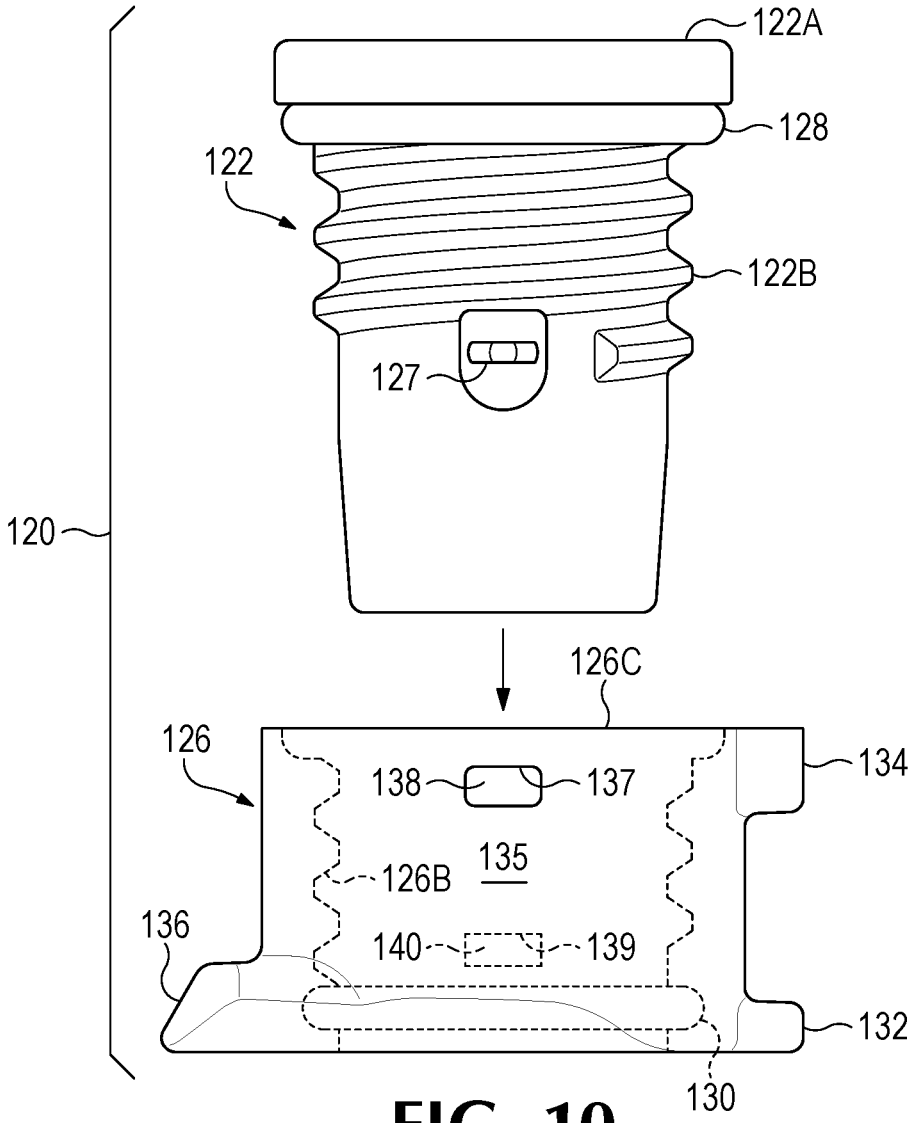
FIG. 10 is an exploded side view of the lock as shown in FIG. 9.

In one embodiment shown in FIGS. 9-10, collar 126 includes lugs 132, 134 and 136 extending radially from the outside surface of the collar. Holes in the wear assembly for receiving collar 126 can include a retaining structure (not shown) with shoulders that engage the lugs 132, 134 and 136 of the lock collar 126 to hold the lock collar 126 in the hole. The collar 126 then receives a pin 122 that advances in the collar 126 to secure the components together. The pin 126 engages inner O-ring 130 as it advances in the collar and compresses outer O-ring 128 as the pin head 122A engages the top surface 126C of collar 126 as described above.

Threaded pin 122 can include a biased latching tooth or detent 127, biased to protrude beyond the surrounding thread 122B. A corresponding outer pocket or recess 138 is formed in the thread 126B of collar 126 to receive detent 127, so that threaded pin 122 latches into a specific position relative to collar 126 when latching detent 127 aligns and inserts with outer pocket 138. The engagement of latching detent 127 in outer pocket 138 holds threaded pin 122 in a release position relative to collar 126, which holds pin 122 outside of cavity 16C (or at least outside of hole 14B with sufficient clearance on nose 14A), so that the wear member 16 can be installed on (and removed from) nose 14A. Alternatively, the detent could be provided on the collar and the pockets or latch openings provided in the pin. The pin 122 is preferably shipped and stored in the release position so that the wear member 16 is ready to install.

Pin 122 is turned to thread into collar 126 to move the pin from the release position to the hold position, which is when latching detent 127 engages the threads 126B of the collar. In one embodiment, there is a noticeable click or "thunk" as the detent 127 engages the pocket 140 providing haptic and/or audible feedback to a user that helps a user determine that pin 122 is fully latched in the proper service position. This haptic feedback results in more reliable installations of wear parts using the present combined collar and pin assembly 120. Likewise, the pin 122 can be turned to move the pin outward for release of the lock for removal of the wear member from the base. The pin may be moved until latch 127 is again received in pocket 138 or until it is fully removed.

To limit ingress of fines into the threads 122B, 126B, pockets or recesses 138 and 140 preferably do not extend through the wall 137, 139 of the collar 126 to open to the outer surface 135. In some embodiments the recess 138, 140 can extend through the wall 137, 139 to open to the outer surface 135 of the collar 126. A plug could optionally be used in such a recess 138, 140 to limit ingress of fines.

While the illustrated embodiment is an excavating tooth, the features associated with the locking of wear member 16 on adapter 14 can be used in a wide variety of wear assemblies for earth working equipment. For example, shrouds, runners, liners, wear plate, picks, crusher tips, etc. could be secured with a lock such as disclosed herein. Such locks could be used to secure a wide variety of wear members to different kinds of earth working equipment including, e.g., dragline buckets, dippers, face shovels, buckets for hydraulic excavators, shear drum machines, continuous miners, roll crushers, chutes, conveyors, truck bodies and the like. Locks as disclosed herein could also be used in other abrasive environments where wear members are secured to bases such as disclosed in U.S. Patent Application 2015/0314297, which is incorporated by reference herein in its entirety. While the use of threads is preferred, the pin and collar could be secured in other ways such as by a retaining pin or set screw, or the pin could have a wedge configuration. In such alternatives, the use of seals to limit the ingress of fines could still be useful in easing and/or speeding the release of the lock (i.e., by removal of the lock or moving the lock to a release position).

The disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The invention claimed is:

1. A lock for securing a wear member to a base for use in an abrasive environment including fines, comprising:

a collar securable in the wear member and having a hole defined by an inner surface, the hole including a circumferential first recess;

a pin having a head and a tapered shank projecting from the head, the shank being movably received in the hole and releasably maintained in the collar in a hold position where the lock secures the wear member to the base, the shank having a circumferential second recess adjacent the head;

a circumferential first seal received in the first recess, which is compressed between the shank and the inner surface when the pin is in the hold position; and a circumferential second seal received in the second recess, which is compressed between the head and the collar when the pin is in the hold position.

2. The lock of claim 1, wherein the shank and the inner surface of the collar each include threads that are engaged and enclosed by the seals when the pin is in the hold position.

3. The lock of claim 2, wherein the collar includes a third recess and a fourth recess, and the shank includes a detent that engages the third recess to releasably secure the pin in the collar in a release position where the wear member can be installed on the base and that engages the fourth recess to releasably secure the pin in the collar in a hold position securing the wear member to the base.

4. The lock of claim 1, wherein the second recess is located near an inner surface of the collar.

5. The lock of claim 1, wherein the shank includes a detent and the collar includes a third recess such that the detent engages into the third recess when the pin is in the collar in a release position where the wear member can be installed on the base.

6. The lock of claim 5, wherein the collar includes a fourth recess such that the detent engages into the fourth recess when the pin is in the collar in a hold position securing the wear member to the base.

7. The lock of claim 1, wherein the collar includes a lug on an outer surface of the collar for securing the collar in the wear member.

8. A lock for securing a wear member to a base for use in an abrasive environment including fines, comprising:

a collar securable in the wear member and having a hole defined by an inner surface that includes threads;

a pin having a shank including threads that engage the threads in the collar, so the pin is movably received in the hole and releasably maintained in the collar in a hold position where the lock secures the wear member to the base; and an inner seal and an outer seal each received between the collar and the pin when the pin is in the hold position, and thereby cooperatively enclosing at least a substantial portion of the engaged threads to limit the ingress of fines into the threads.

9. The lock of claim 8, wherein the collar includes an inner recess and an outer recess, the shank includes a latch releasably engageable with the inner and outer recesses such that the pin is in the hold position when the latch engages the inner recess and in a release position where the wear member can be installed on the base when the latch engages the outer recess.

10. The lock of claim 9, wherein the pin includes a head that compresses the outer seal against the collar when the pin is in the hold position.

11. The lock of claim 10, wherein the shank is tapered and progressively compresses the inner seal as the pin is moved to the hold position.

* * * * *